United States Patent [19]

Giasini

[11] 4,391,037

[45] Jul. 5, 1983

[54] APPARATUS FOR JOINING THIN METAL STRIPS END-TO-END

[76] Inventor: Giovanni Giasini, Via Vespucci 24, Grassobbio, Bergamo, Italy

[21] Appl. No.: 207,079

[22] Filed: Nov. 14, 1980

[30] Foreign Application Priority Data

Nov. 16, 1979 [IT] Italy ..... 27349 A/79

[51] Int. Cl.[3] ..... B23P 21/00; B23Q 15/00

[52] U.S. Cl. ..... 29/716; 29/21.1; 29/432; 29/788

[58] Field of Search ..... 29/432, 432.1, 432.2, 29/21.1, 512, 521, 715, 716, 788

[56] References Cited

U.S. PATENT DOCUMENTS

| | | | |
|---|---|---|---|
| 2,333,966 | 11/1943 | Weiss | 29/21.1 X |
| 2,430,377 | 11/1947 | Vorreyer | 29/21.1 X |
| 2,586,479 | 2/1952 | Pettorossi | 29/21.1 |
| 3,332,473 | 7/1967 | Frederickson et al. | 29/512 UX |
| 3,432,925 | 3/1969 | Woolley | 29/512 X |
| 3,882,264 | 5/1975 | Travis | 29/512 X |

*Primary Examiner*—Charlie T. Moon

*Attorney, Agent, or Firm*—Karl F. Ross; Herbert Dubno

[57] ABSTRACT

Thin metal strips to be temporarily or permanently connected end-to-end, e.g. for successive traverse of a heating zone, are passed with overlapped extremities through a press in which these extremities are jointly perforated from above at several locations by punches of pyramidal shape leaving separate tabs of both strips hanging down in each perforation, these tabs being then bent over and flattened against the lower strip by rising pushers. The series of strips thus interconnected may be continuously advanced toward a furnace or other treatment stage by traction rollers over a path defined by spring-loaded guide rollers forming loops which contract when two sheets to be joined are temporarily clamped in the press.

8 Claims, 8 Drawing Figures

APPARATUS FOR JOINING THIN METAL STRIPS END-TO-END

FIELD OF THE INVENTION

My present invention relates to an apparatus for temporarily or permanently joining thin metal strips end-to-end to one another, e.g. for the purpose of successively passing them through a treatment zone such as a drying oven.

BACKGROUND OF THE INVENTION

Metal strips of this type, ranging in thickness from a few microns to about one millimeter, have heretofore been joined together by adhesively interconnecting their extremities which could then be cut off after treatment. When the treatment involves passage through a long oven or furnace, as for the purpose of drying a varnish or other coating previously applied to the strips, most adhesives—except for some rather expensive ones—cannot withstand the high temperatures so that the oven must be temporarily cooled down until the interconnected extremities have gone through. Such a procedure is highly uneconomical since it wastes thermal energy and also leaves substantial strip portions incompletely treated.

OBJECT OF THE INVENTION

The object of my present invention is, therefore, to provide means for serially interconnecting such metal strips, temporarily or otherwise, in a manner allowing them to be automatically guided in one string through any type of treatment zone and to minimize the amount of material that would go to waste upon a subsequent separation of the strips, without the need for an operator's intervention once the trailing end of the preceding strip has been overlapped with the leading end of a succeeding strip.

SUMMARY OF THE INVENTION

In accordance with my present invention, the overlapping extremities of two such metal strips are interconnected by driving one or more punches from the side of one strip through these extremities to form a corresponding number of throughgoing perforations therein, with punched-out metal from both strips extending through each perforation to form a double burr. This burr is then flattened against the exposed surface of the other strip whereby the two strips are firmly locked to each other.

I have found that cracks or tears beyond the periphery of the perforations can be avoided if these perforations are given a polygonal shape with preferably two pairs of sides so that the punched-out area of each strip will be split along intersecting diagonals of the polygon to form separate tabs of substantially triangular shape which can be readily bent over at their attached bases. Each punch, therefore, advantageously has a tip substantially in the shape of a four-sided pyramid of square, rectangular or rhomboidal outline conforming to that shape.

An apparatus according to my invention comprises clamping means for relatively immobilizing two metal strips with extremities overlapping but accessible from opposite sides to facilitate the operation of punch means approaching these extremities from one side to form one or more throughgoing perforations therein, as discussed above, and deformation means approaching them from the other side to spread the double burr projecting from each perforation and to flatten same in the aforedescribed manner.

Pursuant to a more particular feature of my invention, the clamping means of the apparatus may include a stationary bed of a press frame forming part of a guidepath for the interconnected strips, this guidepath including continuously operable traction means downstream of the press frame and spring-loaded rollers forming a loop which is able to contract upon a temporary clamping of the strips that are being joined together whereby the leading end of the first of these strips can move at a steady speed through and beyond a subsequent drying oven or other treatment zone.

BRIEF DESCRIPTION OF THE DRAWING

The above and other features of my invention will now be described in detail with reference to the accompanying drawing in which.

SPECIFIC DESCRIPTION

Figure 1:
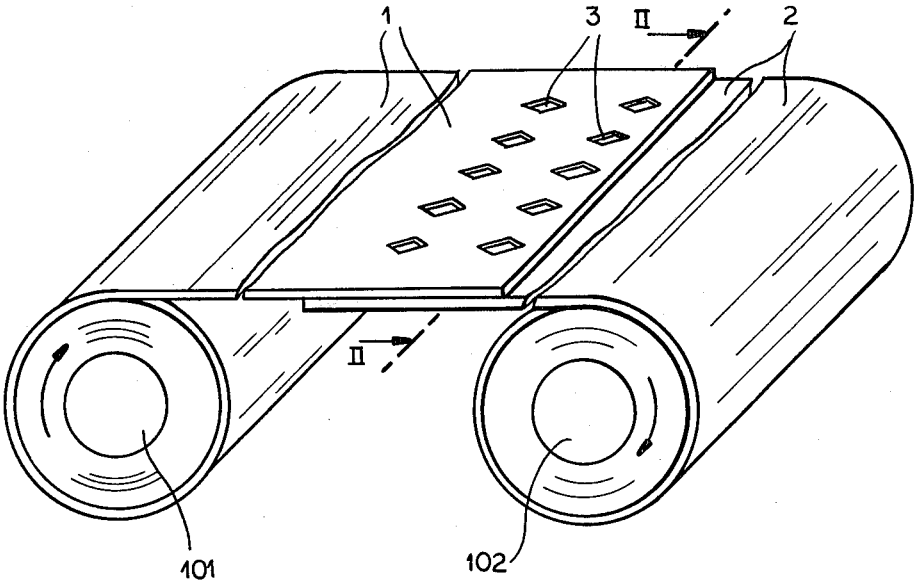
FIG. 1 is a perspective top view of a pair of metal strips with overlapping extremities interconnected according to my present method.
Figure 2:
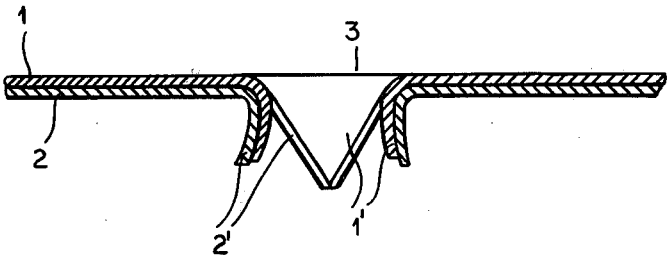
FIG. 2 is a cross-sectional view of the overlapped strip extremities, taken on the line II—II of FIG. 1, after punching but before flattening.
Figure 3:
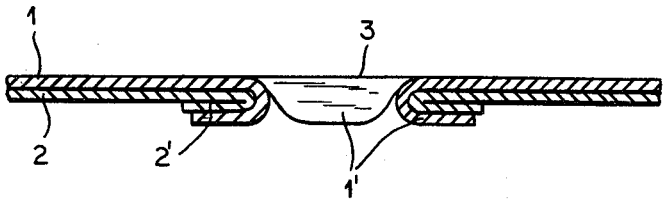
FIG. 3 is a cross-sectional view similar to that of FIG. 2, showing the interconnected extremities after the flattening step.
Figure 4:
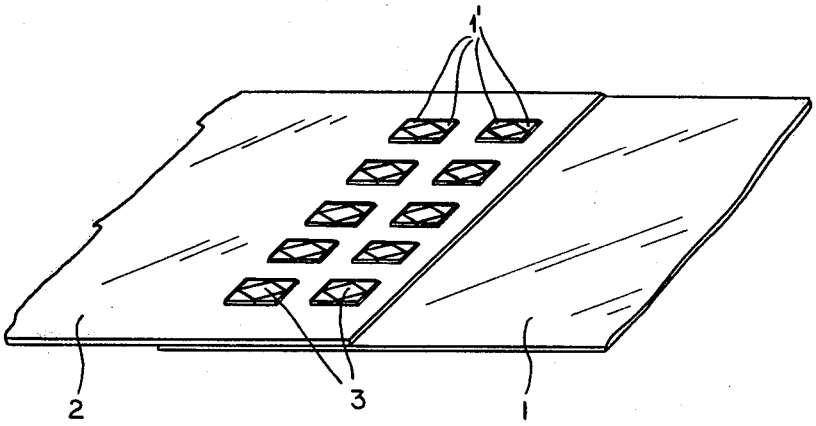
FIG. 4 is a fragmentary perspective bottom view of the interconnected strips.
Figure 5:
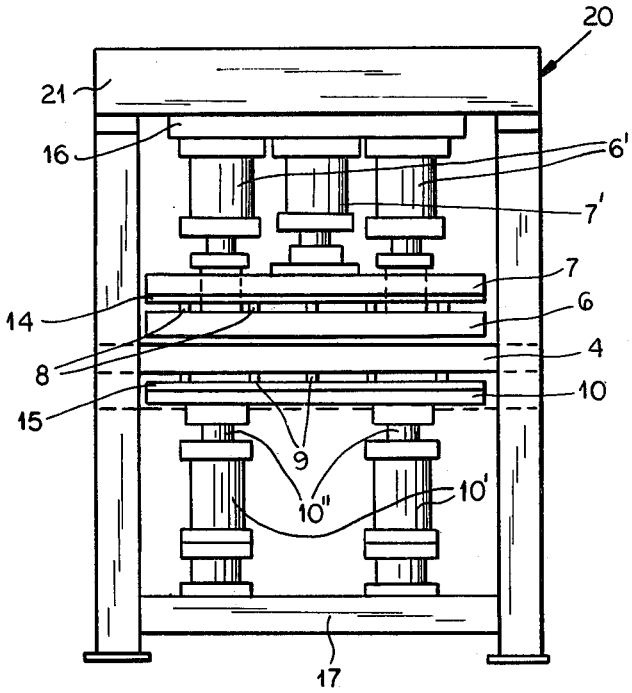
FIG. 5 is an end-elevational view of an apparatus embodying my invention.

In FIGS. 1–4 I have shown two thin metal strips 1 and 2 with overlapping extremities interconnected, in accordance with my present invention, by an array of perforations 3 each having the outline of a four-sided polygon, preferably a square with diagonals seen to extend parallel to the strip edges. In forming these perforations, a double burr split into four substantially triangular tabs 1' and 2' is punched out from each strip as best seen in FIG. 2. After the punching step, assumed to have been performed from the side of strip 1 (i.e. from above as seen in FIGS. 1–3), these tabs hang down in the corresponding perforation 3 and project from the other strip 2. Next, the tabs are flattened against the exposed surface of strip 2 to lock the two strip ends together as shown in FIGS. 3 and 4. With the strip thickness substantially less than the width of each perforation 3, the bent-over tabs occupy the four corners of a square area on the underside of strip 2 (see FIG. 4) which is almost twice that of the corresponding perforation and is bounded by sides paralleling the strip edges.

FIG. 1 shows strip 2 preceding the strip 1 in a series of such strips unwound from a reel 101 and wound upon a reel 102, these strips passing through one or more nonillustrated treatment zones such as a coating stage followed by a drying oven after having been interlinked in the aforedescribed manner. With the diamond-shape positioning of the perforations shown in FIGS. 1 and 4, the areas occupied by the tabs 1', 2' have lateral boundaries paralleling the direction of advance.

In FIGS. 5–8 I have shown a press 20 with a frame 21 forming a stationary bed 4 above which a platen 6 is vertically movable with the aid of pneumatic or hydraulic cylinders 6' whose pistons 6'' traverse a plate 7 which can be independently raised and lowered by the piston 7'' of a similar cylinder 7'. Cylinders 6' and 7' are suspended by a mounting plate 16 from the lintel of frame 21. Two similar cylinders 10' are carried on a base 17 of the frame and have pistons 10'' supporting another independently movable plate 10 below bed 4.

Plate 7 carries a group of piercing tools 8 in the form of punches of four-sided cross-section, held in position thereon by a panel 14, which are guided in respective vertical bores or channels 8' of platen 6 and have tips 8'' in the shape of four-sided pyramids pointing toward bed 4. The latter has similar bores or channels 9' of slightly larger diameter which are coaxial with the respective bores 8' and accommodate pushers 9 that are carried on plate 10 and are held in position thereon by a panel 15. Each pusher 9 comprises a cylindrical sleeve 12 surrounding a pin 11 with a frustoconical tip 11' urged upward by a shock-absorbing spring 11.

Figure 6:
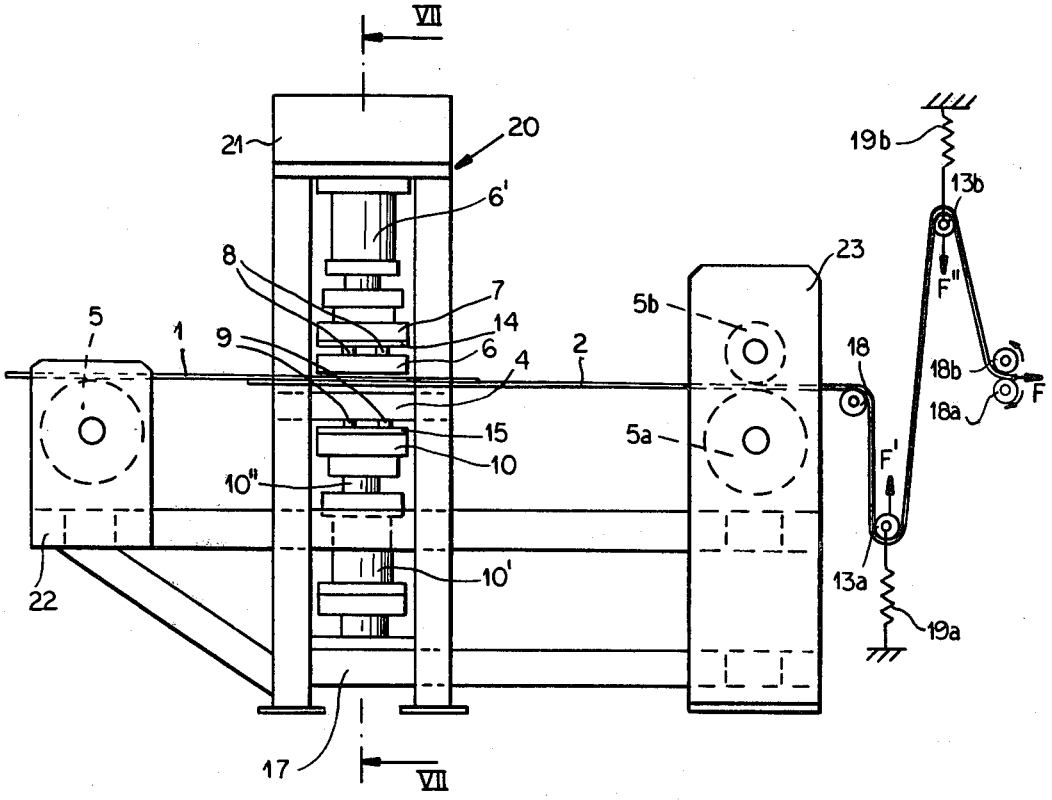
FIG. 6 is a side-elevational view of the apparatus.

As seen in FIG. 6, press 20 is flanked by brackets 22, 23 carrying respective strip-supporting rollers 5 and 5*a* whose zeniths lie on the level of the upper surface of bed 4. Roller 5*a* coacts with a counterroller 5*b*, these latter rollers forming part of a guidepath also including a further supporting roller 18 and coacting transport rollers 18*a*, 18*b*. At least one of the two transport rollers is driven to exert a tractive force F upon a leading strip 2 extracted from press frame 21 in which this strip has been joined to a trailing strip 1 fed in over roller 5. Between guide roller 18 and transport rollers 18*a*, 18*b* I provide two vertically movable deflection rollers 13*a* and 13*b* anchored to respective tension springs 19*a* and 19*b* so as to draw the oncoming strip into two loops. When the tail end of the strip is halted inside the press 20, as described hereinafter, the loops contract against the force of springs 19*a* and 19*b* so that the forward part of the strip can continue its advance through a nonillustrated treatment zone beyond roller pair 18*a*, 18*b*.

Figure 8:
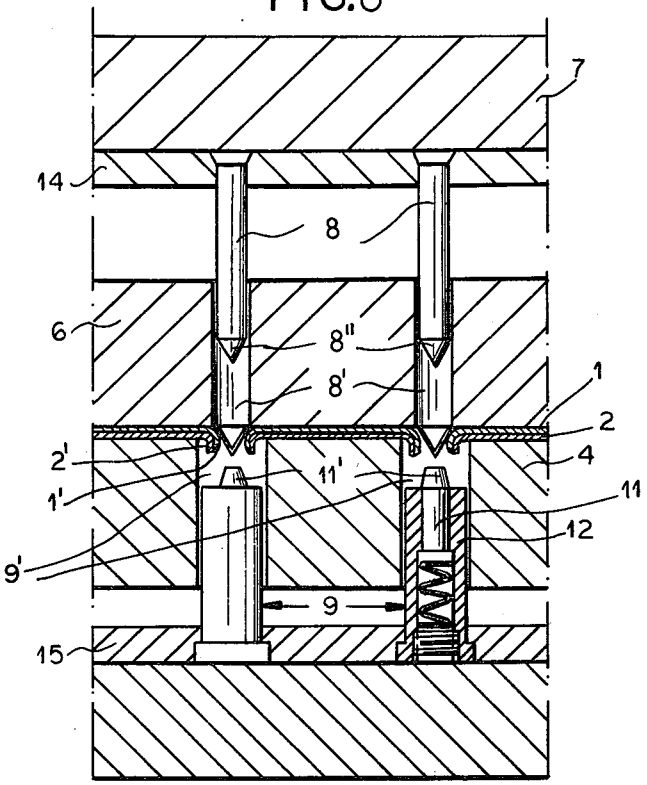
FIG. 8 is a sectional view of the middle part of the assembly shown in FIG. 7, drawn to a larger scale and illustrating an intermediate phase of operation.
Figure 7:
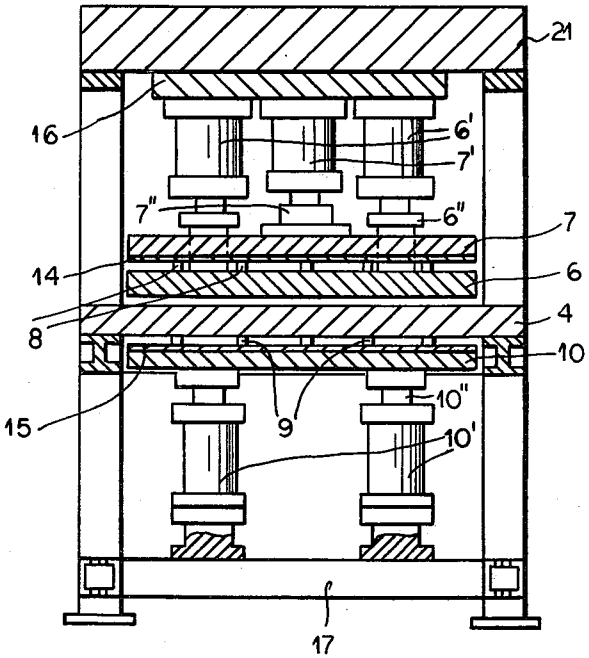
FIG. 7 is a sectional view taken on the line VII—VII of FIG. 6 in an unoperated position of the apparatus.

When the tail end of strip 2 passes over roller 5, an operator places the front end of the next strip 1 on top of strip 2 so that their extremities overlap as they enter the space between bed 4 and the upwardly retracted platen 6. At this point the platen is lowered to clamp the two strip extremities in position whereupon plate 7 decends to let the punches 8 penetrate the two metallic layers in line therewith. This results in the formation of perforations 3 with disjointed double burrs whose tabs 1', 2' hang down into the bores 9' as illustrated in FIG. 8. After the upward withdrawal of punches 8, plate 10 is elevated to raise the pushers 9 into burr-deforming contact with the overlapped strip extremities. The tips 11' of their pins 11 then enter the perforations 3 from below and spread the tabs whereupon sleeves 12 bend the tabs over and flatten them against the underside of strip 2, with the rims of the narrower bores 8' serving as an anvil therefor. Springs 11' serve to cushion the impact between the pins 11 and the depending tabs to be deformed thereby.

While the cylinders 6', 7' and 10' performing the aforedescribed operations could be manually controlled, I prefer to actuate them automatically through a timer in a sequence so related to the speed of transaction rollers 18*a*, 18*b* that the joinder is completed and the strips can be unclamped well before the loop-forming rollers 13*a* and 13*b* have reached the limit of their stroke. In this way, the strips can move at a constant rate through the subsequent processing stages for uniform treatment, e.g. coating.

It will be apparent that the strips need not move horizontally through a press as shown in FIGS. 5–8, though this method of operation will be generally most convenient, but that clamping members 4, 6 could also be vertical, for example, with horizontal reciprocation of the associated tools 8 and 9.

I claim:

1. An apparatus for joining thin metal strips end-to-end, comprising:

clamping means for relatively immobilizing two metal strips with extremities thereof overlapping but accessible from opposite sides;

a plurality of four-sided-cross-section piercing tools on the side of one of said strips operable to form as many throughgoing perforations with two pairs of parallel sides in said overlapping extremities, with punched-out metal from both strips extending through each perforation to form a double burr projecting through the other strip, each of said tools having a tip substantially in the form of a four-sided pyramid with outlines conforming to said perforations adapted to split said double burr into four separate double tabs of substantially triangular shape;

a support having a plurality of openings aligned with said piercing tools; and a plurality of pushers on the side of said other strip disposed opposite said tools and operable to spread said double tabs and flatten same against the perforated extremity of said other strip.

2. An apparatus as defined in claim 1 wherein said pyramid has a square outline.

3. An apparatus as defined in claim 1 or 2 wherein each of said pushers comprises a spreader insertable between said double tabs and provided with a surrounding shoulder for flattening same.

4. An apparatus as defined in claim 3 wherein said clamping means comprises a first flat member with a relatively narrow bore accommodating said tools and a second flat member with a relatively wide bore accommodating said spreaders, said narrow bore being bounded by a rim forming a counterbearing for said shoulder.

5. An apparatus as defined in claim 4 wherein said second member is a stationary bed of a press frame.

6. An apparatus as defined in claim 3 wherein said shoulder is part of a cylindrical sleeve each of, said spreaders being a spring-loaded plunger axially shiftable in said sleeve.

7. An apparatus as defined in claim 5 wherein said bed forms part of a guidepath for said strips including continuously operable traction means downstream of said press frame and spring-loaded rollers forming a loop adapted to contract upon a temporary clamping of said strips between said members.

8. An apparatus as defined in claim 7 wherein said pyramid has an outline with a diagonal paralleling the direction of advance of said strips by said traction means whereby said tabs occupy an area with lateral boundaries paralleling said direction of advance.

* * * * *